US005522124A

United States Patent [19]

Depperman

[11] Patent Number: 5,522,124

[45] Date of Patent: Jun. 4, 1996

[54] ROLLER BURNISHING APPARATUS HAVING DIRECTLY DRIVEN, COAXIALLY DISPOSED BURNISHING HEAD ASSEMBLY

[75] Inventor: Warren B. Depperman, Lugoff, S.C.

[73] Assignee: Cogsdill Tool Products, Inc., Camden, S.C.

[21] Appl. No.: 245,312

[22] Filed: May 18, 1994

[51] Int. Cl.[6] ..... B24B 39/04; B21C 39/30

[52] U.S. Cl. ..... 29/90.01; 29/90.5; 72/78; 310/50

[58] Field of Search ..... 29/90.01, 90.1, 29/90.2, 90.3, 90.5, 90.6, 90.7; 72/77, 78, 86; 310/75 R, 75 D, 50, 309

[56] References Cited

U.S. PATENT DOCUMENTS

| | | | |
|---|---|---|---|
| 997,167 | 7/1911 | Werth | 29/90.5 |
| 1,790,731 | 2/1931 | Thacher | 29/90.5 |
| 2,835,958 | 4/1958 | Mock et al. | 29/90.01 |
| 2,843,918 | 7/1958 | Kopelmann | 29/90.01 |
| 3,226,579 | 12/1965 | Bygdnes | 310/75 R |
| 3,320,652 | 5/1967 | Huber et al. | 29/90.01 |
| 3,422,700 | 1/1969 | Wittwer | 310/75 R |
| 3,560,774 | 2/1971 | Reeves | 310/75 D |
| 3,600,985 | 8/1971 | Carignan | 82/3 |
| 3,626,560 | 12/1971 | Kalen | 29/90.01 |
| 3,736,633 | 6/1973 | Kalen | 29/90.01 |
| 3,791,000 | 2/1974 | Kunze | 29/90.01 |
| 3,795,957 | 3/1974 | Steusloff | 29/90 |
| 3,835,517 | 9/1974 | Walters | 29/90.01 |
| 3,930,294 | 1/1976 | Kalen | 29/90.01 |
| 4,081,704 | 3/1978 | Vassos | 310/50 |
| 4,329,817 | 5/1982 | Balz | 51/163.2 |
| 4,383,427 | 4/1983 | Azarevich et al. | 29/90.01 |
| 4,509,885 | 4/1985 | Dickinson | 29/90.01 |
| 4,835,826 | 6/1989 | Wilson | 29/90.01 |
| 4,916,341 | 4/1990 | Mantovani | 310/50 |
| 4,924,568 | 4/1990 | Sato et al. | 29/90.5 |
| 5,099,558 | 3/1992 | Wilson | 29/90.01 |
| 5,170,645 | 12/1992 | Lonati | 310/75 R |

OTHER PUBLICATIONS

Cogsdill Tool Products, Inc., "Roll-a-Finish Bearingizing CX Machines", Catalog 500-5, pp: 24 and 25, dated 1989.

Cogsdill Tool Products, Inc., "Mirror Master", Flyer 848-2, dated 1990.

*Primary Examiner*—Jack W. Lavinder
*Assistant Examiner*—Christopher W. Day
*Attorney, Agent, or Firm*—Harness, Dickey & Pierce

[57] ABSTRACT

A machine tool apparatus having a burnishing head assembly coupled directly to a hollow, tubular output shaft of the motor of the apparatus. The tubular output shaft is coupled to the armature of the motor and allows a cylindrical workpiece or part inserted into the burnishing head assembly to be received and fed coaxially through the motor. The burnishing head assembly is coupled to the motor such that rotation of the tubular output shaft of the motor causes a corresponding rotation of a plurality of rolls of the burnishing head assembly. When the rolls come into contact with a surface of the workpiece or part, they bear against the surface to effect a roller burnishing of the surface. In the preferred embodiment the rolls are set at a helix angle which causes the rolls to draw the workpiece or part through the tubular output shaft of the motor and burnishing head assembly once contact with the rolls is made, to thereby obviate the need for an individual to manually feed in the part. In the preferred embodiment the burnishing head assembly is also adjustable to enable the rolls to be urged towards each other to reduce the diameter defined by the rolls. The apparatus represents a very compact and more cost efficient tool for effecting roller burnishing of cylindrically shaped workpieces.

22 Claims, 3 Drawing Sheets

ROLLER BURNISHING APPARATUS HAVING DIRECTLY DRIVEN, COAXIALLY DISPOSED BURNISHING HEAD ASSEMBLY

BACKGROUND OF THE INVENTION

1. Technical Field

This invention relates to a burnishing apparatus, and more particularly to a burnishing apparatus having a motor which includes a tubular output shaft and a burnishing head assembly driven directly by the output shaft of the motor without any intermediate gears, drive chains or drive belts.

2. Discussion

Burnishing and bearingizing machines are used in a wide variety of applications to smooth cylindrical shaped work surfaces. Roller burnishing tools typically operate by using tapered rolls which rotate and bear on an inversely tapered mandrel to apply a steady rolling pressure against the work surface. This pressure causes high "peaks" in the surface of the metal workpiece to "flow" into the microscopic "valleys" present on the work surface. This provides extremely accurate sizing while simultaneously providing a very fine finish, as well as work hardening the part surfaces.

Until the present time, burnishing machines have typically incorporated a motor which is coupled to some form of burnishing head assembly or tool by an intermediate gear assembly, drive chain, drive belt, etc. The intermediate assembly typically operates to couple the output shaft of the motor to the burnishing head assembly to thereby drive the race of the tool rotationally. Obviously, the intermediate coupling assembly represents an added component, and therefore an added expense, in the overall machine. The intermediate coupling assemblies also sometimes require periodic adjustment and/or maintenance to maintain acceptable operation.

In view of the above, it is a principal object of the apparatus and method of the present invention to provide a machine tool capable of burnishing the surfaces of cylindrical workpieces which has a burnishing head assembly thereof coupled directly to the output shaft of the motor of the tool to thereby obviate the need for an intermediate gear assembly, drive belt arrangement or drive chain arrangement heretofore required by such tools.

It is another object of the present invention to provide an apparatus and method for performing burnishing operations on cylindrical workpieces which includes a burnishing head assembly for burnishing the surface of the workpiece, where the burnishing head assembly is coupled directly to the output shaft of the motor of the apparatus and coaxially disposed with the output shaft of the motor.

It is still another object of the present invention to provide a machine tool capable of providing burnishing operations which incorporates a tubular output shaft coupled directly to a burnishing head assembly to allow an elongated, cylindrical workpiece to be fed directly into the burnishing head assembly and through the output shaft.

It is still another object of the present invention to provide a machine tool capable of providing a burnishing operation in which the machine tool includes a motor having tubular output shaft coupled directly to an armature of the motor, with the output shaft being coupled directly to a burnishing head assembly such that an elongated, cylindrical workpiece may be fed directly into the burnishing head assembly directly into contact with a plurality of rolls of the tool being driven rotationally by rotational movement of the race being driven by the output shaft, through the output shaft and out the rear of the machine tool. In this manner, no intermediate gear assembly, drive belt or drive chain assembly would be needed to couple the output shaft of the motor to the burnishing head assembly.

SUMMARY OF THE INVENTION

The above and other objects are accomplished by a machine tool apparatus and method having a directly driven, coaxially disposed burnishing head assembly in accordance with a preferred embodiment of the present invention. The apparatus generally comprises a motor having a tubular output shaft coupled directly to an armature thereof, and a burnishing head assembly coupled directly to the tubular output shaft. The apparatus of the present invention thus does not require any form of intermediate gear assembly for driving the burnishing head assembly, nor any form of drive belt or gear chain as needed with prior developed machine tool devices. The burnishing head assembly is driven directly by the output shaft of the motor. In the preferred embodiment the burnishing head assembly includes a plurality of rolls which are disposed for rotational movement, a cage for holding the rolls, a race and a coupling assembly for allowing the tubular output shaft to drive the race, and thus the rolls, rotationally when the motor is turned on.

In operation, a cylindrical workpiece or part is fed into the burnishing head assembly while the motor is turned on. The part is inserted until it comes into contact with the rolls. The rolls are further disposed concentrically with the race, cage and output shaft such that as the part is inserted into the burnishing head assembly a surface of the part comes into contact with the rolls. When the rolls make contact with the surface of the part they cause the part to rotate. In this manner, surface finishing of the part can be accomplished.

In the preferred embodiment the rolls comprise a plurality of tapered rolls which are supported in spaced apart relation to one another within the cage. The cage is fixedly coupled to an adjustable collar of the burnishing head assembly. The race comprises a tapered race which is fixedly coupled to the output shaft. The collar may be adjusted such that the cage is urged laterally relative to the race, which causes the tapered rolls to be urged inwardly towards the output shaft of the motor as well as inwardly relative to the axis of rotation of the output shaft. In this manner the diameter formed by the rolls can be adjusted (i.e., either enlarged or reduced) to accommodate parts of varying diameters.

The preferred embodiment described herein forms a very effective, yet relatively low cost roller burnishing tool for performing roller burnishing operations on cylindrical metal parts. Additionally, while the preferred embodiment shows a burnishing head assembly adapted to roller burnish an outer surface of a cylindrical part, the apparatus could be adapted to work the inner surface of a tubular part if so desired with suitable modifications.

The apparatus of the present invention provides a more compact and less costly tool for burnishing metal parts. Since no intermediate gear assembly, drive belt or drive chain is needed to drive the burnishing head assembly, a more positive driving of the burnishing head assembly is accomplished together with even further increased reliability.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT

Figure 1:
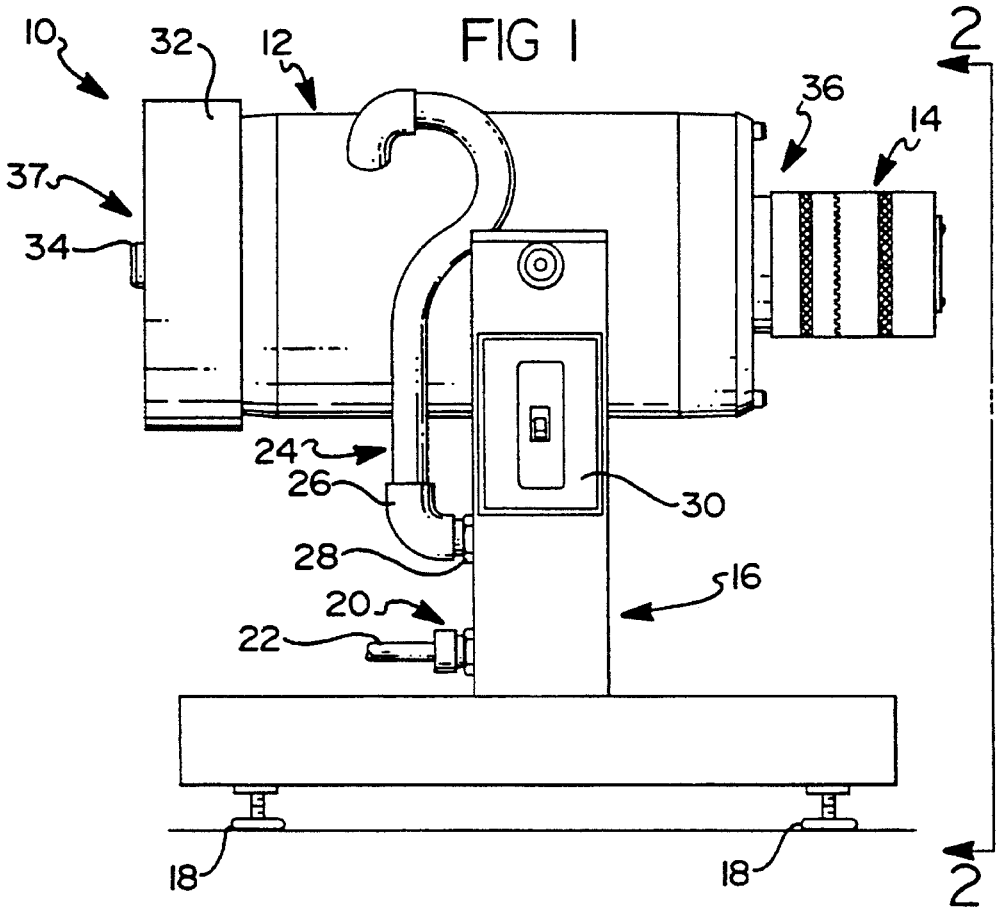
FIG. 1 is an elevational side view of a machine tool apparatus having a directly driven burnishing head assembly in accordance with a preferred embodiment of the present invention.
Figure 2:
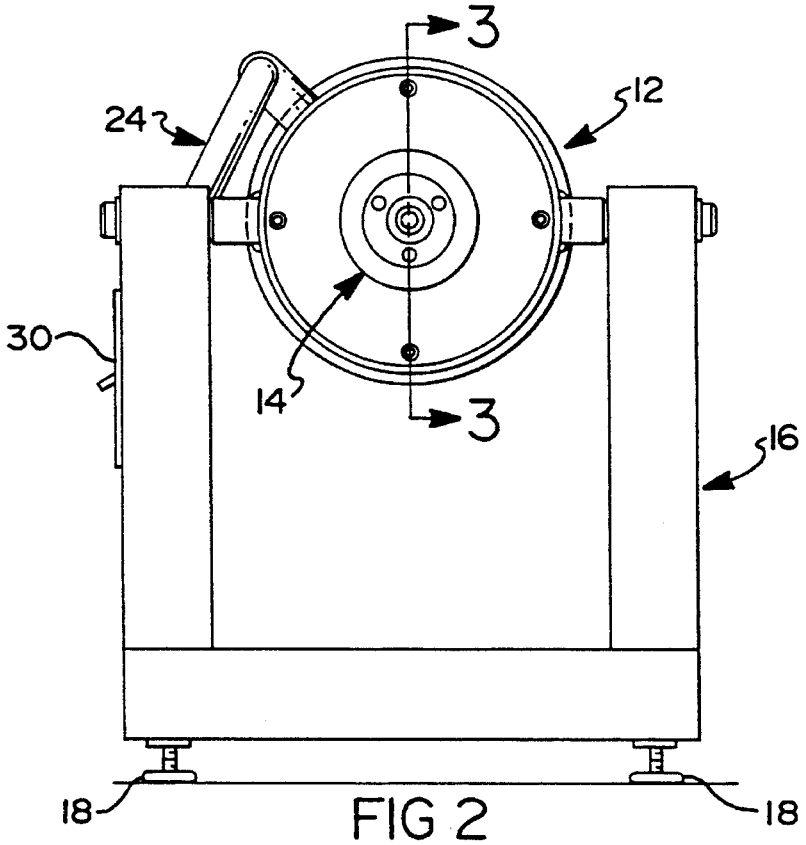
FIG. 2 is an end view of the apparatus of FIG. 1 taken in accordance with directional line 2—2.

Referring to FIGS. 1 and 2, a machine tool apparatus 10 in accordance with a preferred embodiment of the present invention is shown. The apparatus 10 generally comprises a motor 12, a burnishing head assembly 14 coupled directly to the motor so as not to require any intermediate gear assembly, drive belt or drive chain, a frame 16 for supporting the motor 12, and a plurality of foot members 18 for adjustably supporting the frame 16 on a support surface such as a floor or a table top. The frame 16 further includes a fitting 20 for allowing a conduit 22 to be coupled to the frame 16. Within the conduit extends an electric cable (not shown) for supplying current to the motor 12. The frame 16 further includes a conduit 24, an elbow 26 and a fitting 28 for allowing the current carrying cable extending through the conduit 22 to be directed through the conduit 24 to the motor 12. An on/off switch 30 is also mounted on the frame 16 and in series with the current carrying cable to allow the motor 12 to be turned on and off conveniently.

With specific reference to FIG. 1, the motor 12 includes a rear fan guard 32 and a tubular (i.e., hollow) output shaft 34 extending coaxially therethrough into direct coupling with the burnishing head assembly 14. Since the output shaft 34 is tubular, a cylindrical metal part may be slid directly into the burnishing head assembly 14 and through the output shaft 34 from a first end 36 of the motor 12 until the part extends completely through the interior of the motor 12 and exits the output shaft 34.

From FIGS. 1 and 2, it will be appreciated that the apparatus 10 forms a very compact and relatively low cost tool for finishing the surface of a cylindrical metal part. The finishing procedure accomplished by the apparatus 10 is generally known in the art as "roller burnishing" which removes the "peaks" from the surface of a workpiece by forcing the metal forming the peaks into valleys in the surface of the part.

Figure 3:
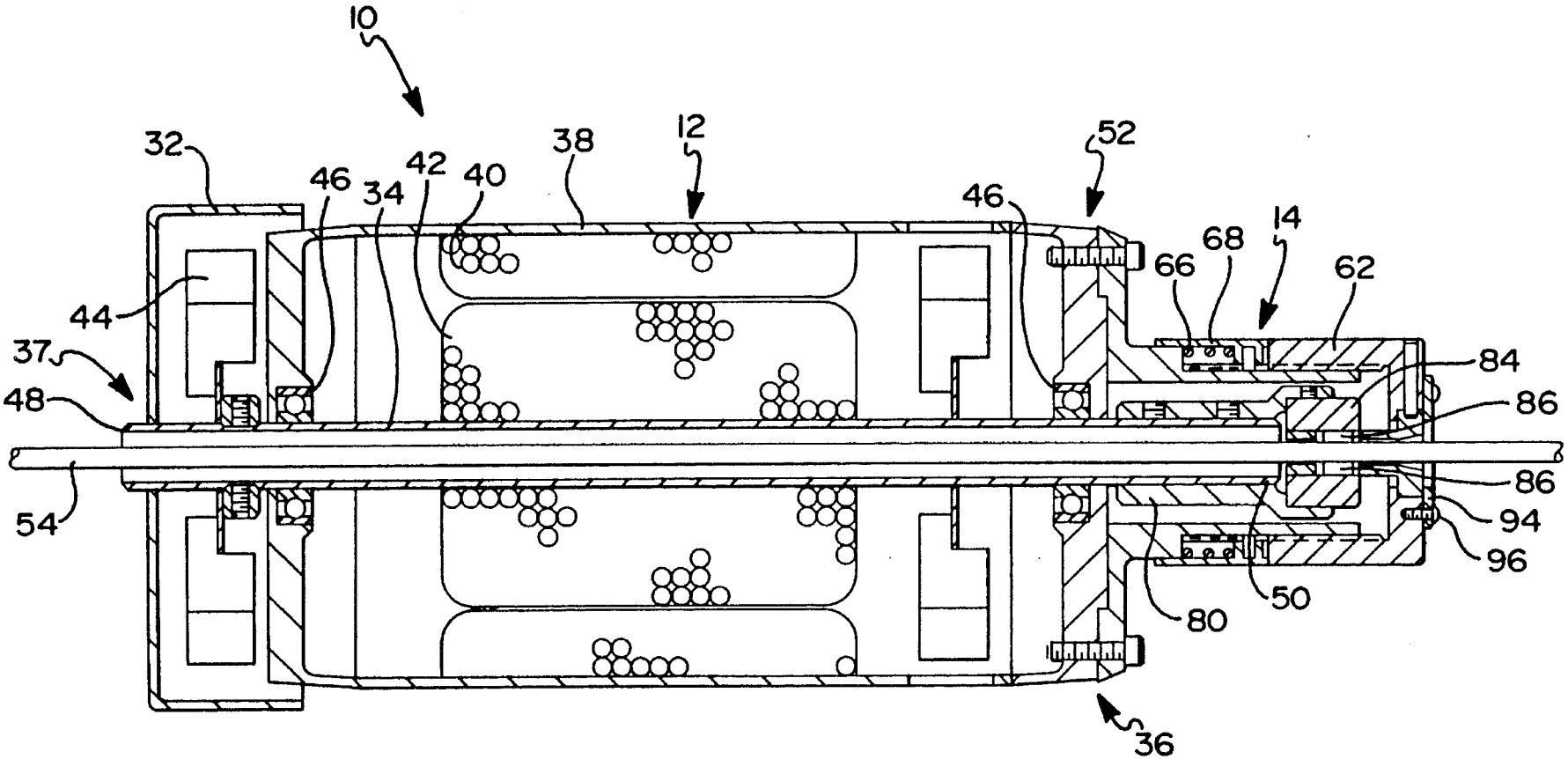
FIG. 3 is a cross sectional side view in accordance with section line 3—3 in FIG. 2 of the motor and burnishing head assembly, and also showing a cylindrical part extending through the burnishing head assembly and through the tubular output shaft of the motor.
Figure 4:
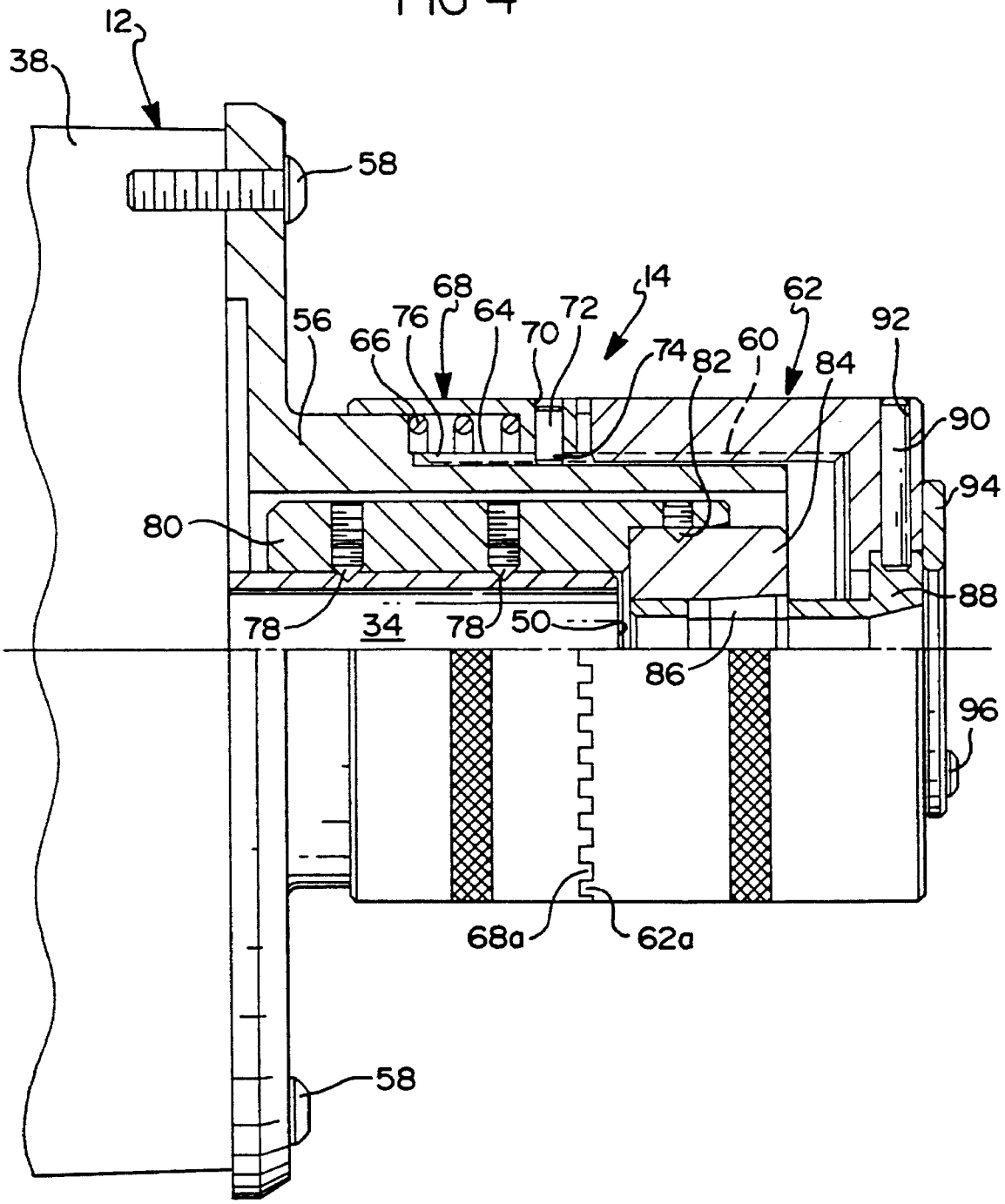
FIG. 4 is a partial cross sectional view of the burnishing head assembly illustrating the teeth on the locking collar and the teeth on the adjusting collar, and the intermeshing arrangement of these teeth which help adjustment of the burnishing head assembly to be effected and maintained.

Referring now to FIGS. 3 and 4, the internal components of the motor 12 and the burnishing head assembly 14 can be seen. Initially, it will be appreciated that the burnishing head assembly 14 is coupled to the motor 12 so as to be concentrically aligned with a longitudinal axis of rotation of the motor 12. With specific reference to FIG. 3, the motor 12 includes a housing 38, a field coil 40 secured to the housing 38, an armature 42 secured fixedly to the tubular output shaft 34 and a fan 44 enclosed within the rear fan guard 32. The tubular output shaft 34 and armature 42 are supported for rotational movement within the housing 38 by a pair of bearings 46. It will be noted that the output shaft 34 has an overall length sufficient to allow an output end 48 to extend outwardly of a second end portion 37 of the motor 12 and an input end portion 50 to extend outwardly of the first end portion 36 of the motor 12 into at least a portion of the burnishing head assembly 14. The inner diameter of the tubular output shaft 48 is of a predetermined size to enable a cylindrical part or workpiece 54 to be inserted thereinto once urged through the burnishing head assembly 14.

With specific reference to FIG. 4, the structure of the burnishing head assembly 14 will now be described. Burnishing head assembly 14 generally includes a flange 56 which is coupled to the housing 38 of the motor 12 via a plurality of threaded screws 58. The flange 56 includes a threaded end portion 60 which engages with a threaded portion of an adjusting collar 62. Accordingly, the adjusting collar 62 can be threadably advanced towards the flange 56 or rotated in the opposite direction to move threadably away from the flange 56.

With further reference to FIG. 4, the flange 56 includes an annular recessed portion 64 in which a coil spring 66 is disposed. A locking collar 68 is positioned over the coil spring 66 and movable slidably laterally relative to the flange 56. The locking collar 68 includes an opening 70 into which a pin 72 is disposed. A lowermost end portion 74 of the pin 72 rides within a slot 76 within the flange 56 when the locking collar 68 is moved laterally to the left or right as viewed in FIGS. 3 and 4.

With continued reference to FIG. 4, the input end 50 of the tubular output shaft 34 is coupled via a plurality of threaded set screws 78 to a housing member 80. The housing member 80 is in turn coupled via a set screw 82 to a race 84. The race 84 is in contact with a plurality of tapered rolls 86 disposed for rotational movement within a cage 88. Accordingly, rotational movement of the tubular output shaft 34 causes a corresponding rotational movement of the housing member 80 and the race 84 to thus drive each of the rolls 86 rotationally. As shown in FIG. 3, when the cylindrical part 54 is inserted in between the rolls 86 while the output shaft 34 is rotating, the rolls 86 "grab" the portion of the part 54 in contact therewith and cause the part 54 to rotate while bearing down on the outer surface of the part 54.

With further reference to FIG. 4, the cage 88 is coupled to the adjusting collar 62 via a roll pin 90 which is inserted into an opening 92 in the adjusting collar 62. The roll pin 90 serves to hold the cage 88 stationary while the race 84 is being rotated by the tubular output shaft 34 during operation of the apparatus 10. The cage 88 is further secured to the adjusting collar 62 by an end plate 94 which is secured to the adjusting collar 62 via a plurality of threaded screws 96.

With specific reference to FIG. 4, adjustment of the adjusting collar 62 is accomplished by grabbing the locking collar 68 with one hand and pulling it towards the motor 12 against the biasing force of the coil spring 66. This causes a plurality of teeth **68*a* of the locking collar 68 to become disengaged with a plurality of teeth 62*a* of the adjusting collar 62. While the locking collar 68 is being held in this disengaged position, the adjusting collar 68 can be rotated threadably with the other hand either towards or away from the motor 12. Moving the adjusting collar 62 rotationally one tooth 68*a* at a time results in the tapered rolls 86 being urged towards or away from the motor 12, which either increases or decreases the diameter formed by the rolls 86 by about 0.0001 inch per each tooth 68*a* moved. In other words, the rolls are urged either axially inwardly or outwardly relative to an imaginary longitudinal axis of rotation extending through the tubular output shaft 34 and the diameter formed by the rolls 86. In this manner the rolls 86 can be adjusted to accommodate varying diameters of parts inserted through the tubular output shaft 34**.

Referring further to FIGS. 3 and 4, the operation of the apparatus 10 will now be described. Initially, an operator inserts the cylindrical part 54 into the burnishing head assembly 14 while the motor 12 is turned on. The operator continues to insert the part 54 until the part 54 comes into contact with the rolls 86. During this time the tubular output shaft 34 is rotating, thus causing the race 84 to rotate, which in turn causes the rolls 86 to be driven rotationally. When the rolls 86 contact the outer surface of the part 54 they begin applying an axially inward force to the outer surface of the part 54 which effects a burnishing action on the outer surface of the part 54.

With further reference to FIG. 4, once the rolls 86 have made contact with the outer surface of the part 54, the angle of the rolls 86 to the longitudinal centerline, which is known in the art as a "helix" angle, causes the rolls 86 to draw the part 54 into the tubular output shaft 48 and completely through the motor 12. In this regard it can be said that the angle of the rolls 86 effects an "automatic feeding" of the part 54 through the apparatus 10. It will be appreciated, however, that if it is desired to effect a burnishing of only a small length of the part 54, that a suitable stop mechanism could be employed with minor modifications to the burnishing head assembly 14 to urge the rolls 86 out of contact with the part 54 after a predetermined portion of the part 54 has fed through the rolls 86. Such structure is available on other forms of burnishing tools available from the assignee of the present application.

From the foregoing description it will be appreciated that the apparatus 10 requires no form of intermediate gear assembly, drive belt or drive chain to coupled the output shaft 48 of the motor 12 to the burnishing head assembly 14. This is a significant advantage over prior developed burnishing tools which, while having proven to be effective for the purposes for which they have been employed, have still required additional components to couple an output shaft of the motor to the structure representing the burnishing tool. The apparatus 10 thus enables a burnishing tool to be constructed less expensively and with less complexity than previously developed burnishing tools. The apparatus 10 further forms a very compact unit which is relatively easy to operate and which provides for a small degree of adjustability to accommodate workpieces or parts having varying diameters. From the above description it will also be appreciated that the burnishing head assembly 14 could be modified so as to allow an inside surface of the tubular part or workpiece to be roller burnished if desired. At the present time it is anticipated that most applications for which the apparatus 10 will be employed will involve roller burnishing an outer surface of a workpiece but the burnishing of inner surfaces of tubular workpieces is certainly possible with suitable modifications which will be appreciated by those of ordinary skill in the art.

The apparatus 10 of the present invention could further be modified by the inclusion of a suitably shaped arbor to provide a bearingizing of the outer surface of the part 54. Still further, as will be appreciated by those of ordinary skill in the art, the burnishing head assembly 12 could be modified to provide a bearingizing effect to an inner surface of a tubular part if desired. Again, however, it is anticipated that the apparatus 10 will be used in most applications to effect roller burnishing of an outer surface of a cylindrical part.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. Apparatus for working a surface of a cylindrical metal part, said apparatus comprising:

a motor having an armature;

a tubular output shaft coupled fixedly to said armature and extending coaxially through said armature so as to rotate with said armature, said output shaft having an inner diameter sufficient to allow said part to be fed completely therethrough;

a burnishing head assembly operably associated with said motor, said burnishing head assembly including:

a plurality of rolls disposed for rotational movement, said rolls further being disposed coaxially with said output shaft of said motor and driven by said output shaft such that when said cylindrical metal part is inserted into said burnishing head assembly said cylindrical part is directed coaxially into contact with said rolls such that a surface of said cylindrical part is forcibly contacted by said rolls and rotated by said rolls to thereby work said surface of said cylindrical metal part, and thereafter fed completely through said output shaft.

2. The apparatus of claim 1, wherein said plurality of rolls comprises a plurality of tapered rolls adapted to engage an outer surface of said cylindrical part.

3. The apparatus of claim 1, wherein said burnishing head assembly is secured via a plurality of threaded members coaxially with an input end of said output shaft of said motor.

4. The apparatus of claim 1, wherein said plurality of rolls are disposed for rotational movement within a cage;

said burnishing head assembly including an adjusting collar;

said cage being fixedly secured to said adjusting collar; and said burnishing head assembly including a coupling fixture being fixedly secured to said output shaft of said motor such that rotational movement of said output shaft causes a corresponding rotational movement of said rolls, to therefore cause said rolls to turn said cylindrical part and to draw said cylindrical part into and through said output shaft while exerting an axially inward force on said part.

5. The apparatus of claim 1, further comprising a frame for supporting said motor.

6. The apparatus of claim 5, further comprising a plurality of foot members for adjustably supporting said frame above a support surface.

7. The apparatus of claim 5, wherein said frame includes mounted thereon a switch for turning on and off said motor.

8. The apparatus of claim 4, wherein said coupling fixture comprises:

a housing member fixedly secured with said output shaft so as to rotate with said output shaft;

a race fixedly coupled with said housing member so as to rotate with said housing member;

said race, when driven rotationally by said output shaft, causing said rolls to be driven rotationally to thereby cause said part in contact with said rolls to be rotated and drawn into said output shaft.

9. A roller burnishing apparatus comprising:

a motor having a housing having a first end and a second end, an armature, a tubular output shaft fixedly secured to said armature so as to extend concentrically through said armature and driven rotationally in accordance with rotational movement of said armature;

a burnishing head assembly coupled to one of said first and second ends of said motor housing, said burnishing head assembly including:

a plurality of rolls disposed for rotational movement and being disposed coaxially with a longitudinal axis of rotation of said output shaft;

a coupling assembly for causing said rolls to be driven rotationally in accordance with rotational movement of said output shaft such that a cylindrical part inserted into said burnishing head assembly extends into contact with said rolls as said rolls are driven rotationally to thereby cause a surface of said part to be finished by said rolls; and whereby said part is fed into and through said output shaft and exits the end of said motor opposite to the end to which said burnishing head assembly is coupled.

10. The apparatus of claim 9, further including a switch disposed on said frame and electrically coupled with said motor to control on and off operation of said motor.

11. The apparatus of claim 10, wherein said burnishing head assembly is disposed coaxially relative to one of said first and second ends of said motor.

12. The apparatus of claim 9, wherein said coupling assembly includes a housing member fixedly secured to a portion of said output shaft;

a race fixedly secured to said housing member and in contact with said rolls so as to cause said rolls to rotate in accordance with rotational movement of said output shaft; and a cage for supporting said rolls for rotational movement and for maintaining said rolls in predetermined positions about a circumference of said part.

13. The apparatus of claim 12, wherein said burnishing head assembly further comprises:

an adjusting collar fixedly secured to said cage;

a flange secured to said motor;

said adjusting collar being adjustable relative to said flange in a manner to allow said cage to be adjusted laterally relative to said race to thereby allow an internal diameter formed by said rolls through which said cylindrical part passes to be adjusted to allow said rolls to accommodate cylindrical parts having varying diameters.

14. The apparatus of claim 13, wherein said adjusting collar is threadably engageable with a portion of said flange of said burnishing head assembly.

15. The apparatus of claim 14, further comprising a coil spring disposed about a portion of said flange;

a locking collar disposed over said coil spring and moveable slidably over a portion of said flange;

a plurality of teeth formed on said locking collar;

a plurality of teeth formed on said adjusting collar adapted to meshingly engage with said teeth of said locking collar;

said coil spring operating to provide a biasing force to said locking collar to hold said teeth of said locking collar threadably engaged with said teeth of said adjusting collar to thereby maintain said adjusting collar in a fixed position relative to said flange.

16. The apparatus of claim 15, further comprising an end plate for securing said cage to said adjusting collar to thereby maintain said cage stationary during operation of said motor and rotation of said rolls.

17. A method for working a surface of a cylindrical workpiece to smooth said surface, said method comprising the steps of:

providing a motor having an armature;

providing a tubular output shaft positioned coaxially within said armature;

coupling said tubular output shaft to said armature;

coupling a burnishing head assembly directly to said tubular output shaft coaxially with a longitudinal axis of rotation of said tubular output shaft;

causing said tubular output shaft to rotate;

causing a plurality of rolls to be driven by rotation of said tubular output shaft;

feeding a cylindrical workpiece into said burnishing head assembly such that a surface of said workpiece comes into contact with said rolls and is thereby driven rotationally by said rolls while said rolls apply an axially inward force to said workpiece; and continuing to feed said cylindrical workpiece through said rolls and coaxially into said tubular output shaft such that said workpiece is fed at least partially through said tubular output shaft.

18. The method of claim 17 further comprising the step of:

causing said rolls to feed said cylindrical workpiece entirely through said tubular output shaft such that said cylindrical workpiece exits an end of said motor.

19. The method of claim 18, further comprising the step of:

adjusting said burnishing head assembly to cause said rolls to be urged inwardly relative to a longitudinal axis of rotation of said tubular output shaft.

20. The method of claim 19, further comprising the step of:

providing a biasing force to a portion of said burnishing head assembly to help maintain said rolls at a desired distance from said longitudinal axis of rotation of said tubular output shaft.

21. The method of claim 17, wherein said contact of said surface of said cylindrical workpiece with said rolls causes said surface of said cylindrical workpiece to be roller burnished by said rolls.

22. Apparatus for working a surface of a cylindrical part, said apparatus comprising:

a motor having an armature and a tubular output shaft extending coaxially through said armature and fixedly coupled to said armature so as to be driven rotationally by said armature;

a metal working tool disposed coaxially relative to said output shaft and driven by said output shaft for accepting said cylindrical part and performing a metal-working operation on said cylindrical part; and said tubular output shaft enabling said cylindrical part to be fed coaxially into and through said motor as said metal-working operation is performed.

* * * * *